United States Patent [19]

Morishita

[11] Patent Number: 4,848,172

[45] Date of Patent: Jul. 18, 1989

[54] PLANETARY GEAR REDUCTION STARTER

[75] Inventor: Akira Morishita, Hyogo, Japan

[73] Assignee: Mitsubishi Denki Kabushiki Kaisha, Tokyo, Japan

[21] Appl. No.: 181,292

[22] PCT Filed: Jun. 25, 1987

[86] PCT No.: PCT/JP87/00421

§ 371 Date: Mar. 30, 1988

§ 102(e) Date: Mar. 30, 1988

[87] PCT Pub. No.: WO88/00293

PCT Pub. Date: Jan. 14, 1988

[30] Foreign Application Priority Data

Jun. 25, 1986 [JP] Japan ..... 61-148814

[51] Int. Cl.[4] ..... F02N 15/02

[52] U.S. Cl. ..... 74/7 E; 74/801

[58] Field of Search ..... 74/7 E, 785, 801

[56] References Cited

U.S. PATENT DOCUMENTS

| | | | |
|---|---|---|---|
| 4,494,414 | 1/1985 | Hamano . | |
| 4,503,719 | 3/1985 | Hamano | 74/7 E |
| 4,561,316 | 12/1985 | Bolz et al. | 74/7 E |
| 4,651,575 | 3/1987 | Morishita et al. | 74/7 E |
| 4,680,979 | 7/1987 | Morishita et al. | 74/7 E |
| 4,712,451 | 12/1987 | Morishita et al. | 74/7 E X |
| 4,739,181 | 4/1988 | Okamoto et al. | 74/801 X |

*Primary Examiner*—Peter A. Aschenbrenner

*Attorney, Agent, or Firm*—Sughrue, Mion, Zinn, Macpeak and Seas

[57] ABSTRACT

A planetary gear reduction starter, in which for the purpose of improvement of impact absorbing property and breaking-resistance property of an internal gear (11, 30*a*) receiving pressure of a planet gear (7), an elastic body (22, 31) is mounted on an outer circumference of the internal gear, and the elastic body is disposed in opposition to a housing (5, 21) through a gap/gaps (23; 32, 33) therebetween.

3 Claims, 1 Drawing Sheet

PLANETARY GEAR REDUCTION STARTER

TECHNICAL FIELD

The present invention relates to an improvement in a starter using a planetary reduction gear mechanism.

BACKGROUND ART

A conventional starter of this type is that shown in FIG. 1, wherein a DC motor 1 is constituted by a rotary shaft 2, an armature 3 attached to the rotary shaft 2, a permanent magnet 4 disposed in opposition to the armature 3 through a gap, and a yoke 5 for supporting the permanent magnet 4. A solar or spur gear 6 is formed on the rotary shaft 2 of the DC motor 1, a planet gear(s) 7 is engaged with the spur gear 6, and a support pin 8 for supporting the planet gear 7 is fixed to a flange 9 which is integrally fixed to an output rotary shaft 10. A ring-like internal gear 11 made of a resin material such as nylon or the like meshes with the outer circumference of the planet gear 7 so as to guide the planet gear 7. The internal gear 11 constitutes a planetary gear reduction device together with the spur gear 6 and the planet gear 7. A front bracket 12 is spigot-fitted to the yoke 5 of the DC motor 1. An intermediate bracket 13 has an outer circumferential portion engaged with a spigot portion 12*a* of the front bracket 12 and an inner circumferential portion arranged to support the output rotary shaft 10 through a sleeve bearing 14. A rubber ring 15 is mounted onto the spigot portion 12*a* of the front bracket 12 together with the internal gear 11 and the intermediate bracket 13 in such a manner that the rubber ring 15, the internal gear 11 and the intermediate bracket 13 are in close contact with the spigot portion 12*a* of the front bracket 12 in the axial direction and in close contact with each other in the radial direction. A thrust washer 16 is provided between the yoke 5 and the rotary shaft 2. A sleeve bearing 17 is provided between the rotary shaft 2 and the output rotary shaft 10, and another sleeve bearing 18 is provided between the planet gear 7 and the support pin 8. Steel balls 19 are provided between the armature rotary shaft 2 and the output rotary shaft 10 at their respective end portions so as to transfer a thrust load to each other. Helical splines 20 are formed on the output rotary shaft 10 at its outer circumferential surface and a not-shown overrunning clutch (including a pinion) is spline-fitted slidably axially.

Next, the operation of the above arrangement will be described. When the armature 3 is energized to generate rotary force, the rotary force is transmitted to the armature rotary shaft 2 and is further transmitted to the flange 9 through the spur gear 6, the planet gear 7, and the support pin 8, so that the rotational speed of the armature 3 is reduced by the planetary gear reduction mechanism and is transmitted to the output rotary shaft 10.

In the thus arranged conventional planetary gear reduction starter, since the internal gear 11 is made of resin such as nylon or the like, the internal gear 11 per se would be flexed when an impact is generated in starting an engine to thereby absorb the impact. However, the internal gear 11 is mounted onto the front bracket 12 in close contact with the latter radially as well as axially, so that even if an impact load due to a normal torque fluctuation in an engine is exerted on the internal gear 11, the amount of flexure of the internal gear 11 is so small that the normal impact load can not be absorbed.

In the case where the radial gap between the internal gear 11 and the front bracket 12 is made large, there has been a problem in that an engine is suddenly stopped in starting the engine, and when a pinion of the starter and a ring gear of the engine are not suitably engaged with each other so that the respective tooth-end surfaces of the former and the latter collide with each other, a large impact load is exerted on the internal gear 11 to transform the internal gear 11 in the radial direction too much to thereby brake the internal gear 11.

The present invention is achieved to solve the above-described problems, and therefore it is an object of the present invention to provide a planetary gear reduction starter in which when a normal impact load is exerted on an internal gear, the internal gear and an elastic body are effectively flexed to absorb the impact, while when an abnormally larger impact load is exerted on the internal gear, abnormal transformation of the internal gear is prevented to thereby prevent the internal gear from being broken.

SUMMARY OF THE INVENTION

In order to attain the above objects, according to the present invention, the planetary gear reduction starter is arranged such that an annular elastic body is mounted on an outer circumference of an internal gear made of resin, and the elastic body is disposed in opposition to a housing through a gap so that a predetermined impact load can be absorbed.

In the planetary gear reduction starter according to the present invention, when a normal impact load is exerted on the internal gear, the internal gear and the elastic body are effectively flexed within the radial gap to thereby absorb the impact, while when an abnormal impact load larger than the normal one is exerted on the internal gear, the elastic body is transformed to thereby absorb the impact and abnormal transformation of the internal gear can be prevented by the inner circumferential surface of the housing.

DETAILED DESCRIPTION OF THE PREFERRED EMBODIMENTS

Referring to the accompanying drawings, embodiments of the present invention will be described hereunder in detail.

Figure 1:
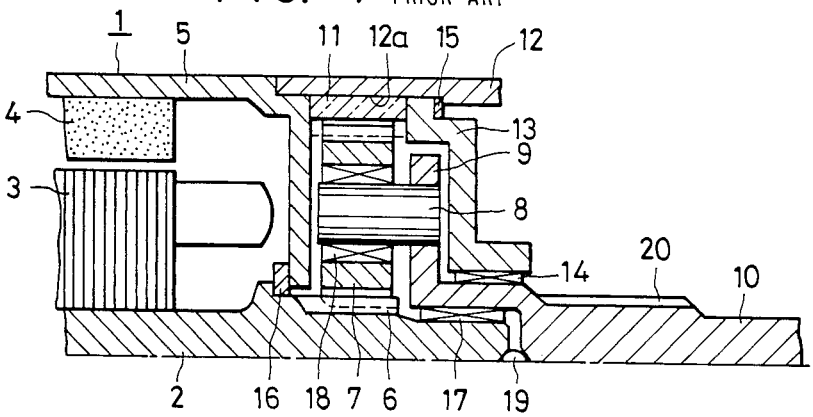
FIG. 1 PRIOR ART
FIG. 1 is a cross-section showing a conventional planetary gear reduction starter.
Figure 2:
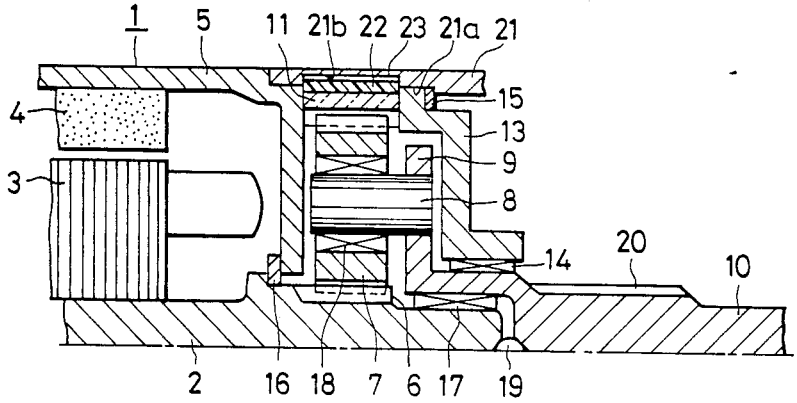
FIG. 2 is cross-section showing an embodiment of the planetary gear reduction starter according to the present invention.

FIG. 2 is a cross-section showing an embodiment of the planetary gear reduction starter according to the present invention. In the drawing a front bracket 21 constitutes a housing on which a spigot portion 21*a* is formed at a position where a yoke 5 of a DC motor 1 is fitted to the front bracket 21, and an annular groove 21*b* is formed in the spigot portion 21*a*. A rubber ring 22 made of rubber or the like is mounted on the outer circumferential surface of an internal gear 11 so as to be in opposition to the inner circumferential surface of the groove 21*b* of the front bracket 21 through a radial gap 23. The internal gear 11 and the rubber ring 22 are attached in a close-contact relationship with each other. The other features are is substantially the same as in FIG. 1, so that the description will be omitted.

The thus arranged embodiment is assembled in such a manner that the rubber ring 22 is mounted on the outer circumference of the internal gear 11 by pressure-fitting or by any other suitable means, that the internal gear 11, the intermediate bracket 13, and the rubber ring 15 are interposed between the front bracket 21 and the yoke 5, and that the front bracket 21 and the yoke 5 are fastened to each other by not-shown through bolts.

In such an arrangement as shown in FIG. 2, since the radial gap 23 is formed between the rubber ring 22 and the front bracket 21, when a normal impact load is exerted on the internal gear 11, the internal gear 11 and the rubber ring 22 are flexed by their own flexibility to thereby absorb the impact, while if an impact load larger than the normal one is exerted on the internal gear 11, the internal gear 11 is radially flexed by its own flexibility and the rubber ring 22 is also radially flexed to thereby absorb the impact. The quantity of the maximum radial flexure of the internal gear 11 is equal to dimension of the radial gap 23, and the flexure larger than the maximum flexure quantity is restricted by the inner circumferential surface of the groove 21*b* of the front bracket 21. Accordingly, the radial gap 23 is set to a predetermined optimum value so that a large impact load exerted on the starter can be absorbed and the internal gear 11 is prevented from being broken by its abnormal transformation.

Figure 3:
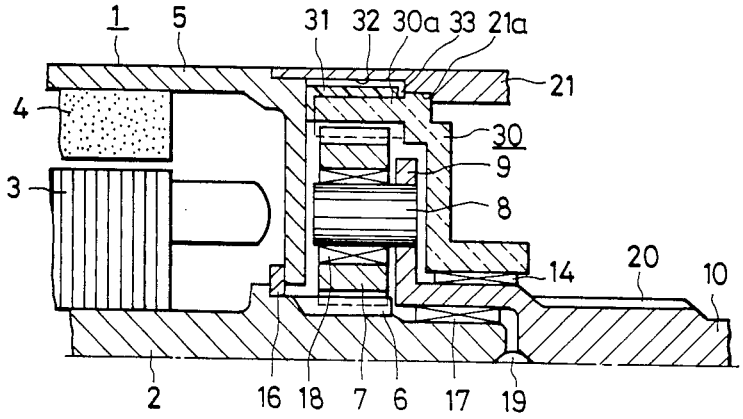
FIG. 3 is a cross-section showing another embodiment of the planetary gear reduction starter according to the present invention.

Although a case where the internal gear 11 and the intermediate bracket 13 are formed separately from one another has been illustrated in the above embodiment, the present invention is applicable to such a case as shown in FIG. 3 in which the internal gear 11 and the intermediate bracket 13 are formed integrally with each other.

That is, in FIG. 3, there is provided an intermediate bracket 30 made of resin such as nylon. The intermediate bracket 30 has an axially projecting cylindrical portion integrally formed at the outer circumferential side. A gear is formed on the inner circumferential surface of the cylindrical portion so as to constitute an internal gear 30*a*. A rubber ring 31 of an elastic body having an L-shaped cross-section is mounted on the outer circumference of the internal gear 30*a* so that a radial gap 32 and an axial gap 33 are provided between the rubber ring 31 and the inner circumferential surface of the front bracket 21.

In the thus arranged embodiment, when a normal impact load is exerted on the internal gear 30*a*, the internal gear 30*a* is flexed by its own flexibility to thereby absorb the impact, while when an abnormal impact load larger than the normal one is exerted on the internal gear 30*a*, the internal gear 30*a* and the rubber ring 31 are radially transformed by their own flexibility and axially transformed if the radial transformation is restricted by the radial inner circumferential surface of the internal gear 30*a*, so that the internal gear 30*a* and the rubber ring 31 are radially and axially flexed within the radial gap 32 and the axial gap 33 to thereby absorb the impact. In that case, the maximum flexure quantity of the internal gear 30*a* depends on the radial gap 32 and the axial gap 33, and the further flexure quantity is restricted by the inner circumferential surface of the front bracket 21. Accordingly, the radial gap 32 and the axial gap 33 are set to predetermined optimum values respectively so that a large impact load exerted on the starter can be absorbed and the internal gear 30*a* can be prevented from being broken by its abnormal transformation. Although the embodiment has been described as to the case where the radial gap 32 and the axial gap 33 are provided between the outer circumferential portions of the rubber ring 31 of the elastic body and the inner circumferential portions of the front bracket 21, a circumferential gap may be provided between the outer circumferential portion of the rubber ring 31 and the inner circumferential portion of the front bracket 21 so as to absorb a predetermined impact load. Further, although the above embodiments have been described as to the case where the internal gear 11/30*a* is mounted on the inner circumference of the front bracket 21, the present invention may be applicable to a case where the inner gear is mounted on the yoke 5 constituting the housing or mounted on both the front bracket 21 and the yoke 5.

As described above, according to the present invention, an annular elastic body is mounted on the outer circumference of an internal gear made of resin, and the elastic body is disposed in opposition to a housing through a gap so as to be able to absorb a predetermined impact load. Accordingly, when a normal impact load is exerted on the internal gear, the elastic body and the internal gear are effectively flexed to thereby absorb the impact, while when an abnormal impact load larger than the normal one is exerted on the internal gear, abnormal transformation of the internal gear can be prevented to thereby prevent the internal gear form being broken. Thus, the disadvantage in the prior art that the internal gear is broken can be eliminated. Accordingly, a planetary gear reduction starter having high reliability can be obtained.

I claim:

1. In a planetary gear reduction starter comprising an electric motor, a planet gear for transmitting rotation of a rotary shaft of said motor with a reduced rotational speed to an output rotary shaft, a ring-like internal gear made of resin for guiding said planet gear, and a housing constituted by a yoke of said motor or a front bracket for supporting said internal gear, the improvement in which an annular elastic body is mounted on an outer circumference of said internal gear and disposed in opposition to said housing through a radial gap (23; 32) formed between an outer circumferential portion of said elastic body and an inner circumferential portion of said housing so as to be able to absorb a predetermined impact load.

2. In a planetary gear reduction starter comprising an electric motor, a planet gear for transmitting rotation of a rotary shaft of said motor with a reduced rotational speed to an output rotary shaft, a ring-like internal gear made of resin for guiding said planet gear, and a housing constituted by a yoke of said motor or a front bracket for supporting said internal gear, the improvement in which an annular elastic body is mounted on an outer circumference of said internal gear and disposed in opposition to said housing through a radial gap (32) and an axial gap (33) formed between outer circumferential portions of said elastic body and inner circumferential portions of said housing, respectively, so as to be able to absorb a predetermined impact load.

3. A planetary gear reduction starter according to claim 2, in which said annular elastic body has an L-shaped cross-section.

* * * * *